US008695794B2

(12) United States Patent
Scatterday

(10) Patent No.: US 8,695,794 B2
(45) Date of Patent: Apr. 15, 2014

(54) ELECTRONIC CIGARETTE CONTAINER AND METHOD THEREFOR

(75) Inventor: Mark Scatterday, Scottsdale, AZ (US)

(73) Assignee: NJoy, Inc., Scottsdale, AZ (US)

( * ) Notice: Subject to any disclaimer, the term of this patent is extended or adjusted under 35 U.S.C. 154(b) by 0 days.

(21) Appl. No.: 13/490,352

(22) Filed: Jun. 6, 2012

(65) Prior Publication Data

US 2013/0140200 A1 Jun. 6, 2013

Related U.S. Application Data

(60) Provisional application No. 61/548,122, filed on Oct. 17, 2011, provisional application No. 29/404,202, filed on Oct. 17, 2011.

(51) Int. Cl.
*B65D 85/10* (2006.01)

(52) U.S. Cl.
USPC ..... 206/242; 206/782; 206/485

(58) Field of Classification Search
USPC ..... 206/485, 242, 244, 265, 267, 276, 775, 206/782
See application file for complete search history.

(56) References Cited

U.S. PATENT DOCUMENTS

| | | | | |
|---|---|---|---|---|
| 3,941,300 | A * | 3/1976 | Troth | 229/5.5 |
| 4,848,563 | A * | 7/1989 | Robbins | 206/315.9 |
| 5,005,759 | A * | 4/1991 | Bouche | 229/125.26 |
| 5,641,064 | A * | 6/1997 | Goserud | 206/315.1 |
| 5,975,415 | A * | 11/1999 | Zehnal | 229/223 |
| 6,622,867 | B2 * | 9/2003 | Menceles | 206/771 |
| 6,672,762 | B1 * | 1/2004 | Faircloth et al. | 383/9 |
| 7,000,775 | B2 * | 2/2006 | Gelardi et al. | 206/776 |
| 7,374,048 | B2 * | 5/2008 | Mazurek | 206/776 |
| 7,621,403 | B2 * | 11/2009 | Althoff et al. | 206/581 |
| 7,644,823 | B2 * | 1/2010 | Gelardi et al. | 206/776 |
| 2001/0032795 | A1 * | 10/2001 | Weinstein et al. | 206/321 |
| 2005/0061759 | A1 * | 3/2005 | Doucette | 211/85.4 |

* cited by examiner

*Primary Examiner* — Jacob K Ackun
(74) *Attorney, Agent, or Firm* — Bookoff McAndrews, PLLC

(57) ABSTRACT

An electronic cigarette container has a main body section having a hollow interior, the main body section having an open top end. A top cover is coupled to the main body section to cover the open top end. A holding mechanism is formed at a bottom end of the main body section to hold an electronic cigarette.

5 Claims, 3 Drawing Sheets

ELECTRONIC CIGARETTE CONTAINER AND METHOD THEREFOR

RELATED APPLICATIONS

This invention is related to U.S. Provisional Application entitled "An Electronic Cigarette Container and Method Therefor", having Ser. No. 61/548,122, filed Oct. 17, 2011, in the name of the same inventor and which is further related to U.S. Design Patent entitled "Ornamental Design For An Electronic Cigarette Container", having Ser. No. 29/404,202 filed Oct. 17, 2011, in the name of the same inventor and which application is incorporated by reference herein.

BACKGROUND

This invention relates generally to a cigarette/cigar product, and more specifically, to a container for storing and removing an electronic cigarette/cigar.

Electronic cigarettes/cigars (hereinafter electronic cigarettes) are becoming popular alternative smoking products. Presently, most electronic cigarettes are distributed in closed rectangular containers similar to conventional cigarettes. These containers do not allow one to see the actual product. Further, with present containers, it is difficult to place the containers on a display to show the product. Present, containers are generally stacked on top of one another which do not allow packaging/labeling on the containers to be properly displayed. Alternatively, the containers are placed upright on a bottom surface of the container for display purposes which may be unstable and cause the container to fall off the display when bumped.

Therefore, it would be desirable to provide a device and method that overcomes the above problems.

SUMMARY

An electronic cigarette container has a main body section having a hollow interior, the main body section having an open top end. A top cover is coupled to the main body section to cover the open top end. A holding mechanism is formed at a bottom end of the main body section to hold an electronic cigarette.

An electronic cigarette container has a main body section having a hollow interior, the main body section having an open top end. A holding mechanism is formed at a bottom end of the main body section to hold an electronic cigarette. A top cover is coupled to the main body section to cover the open top end. A securing mechanism is formed on an interior surface of the top cover. The securing mechanism removes the electronic cigarette from the container when the top cover is removed from the main body. The securing device is a circular tube member. A diameter of the circular tube member is dimensioned to allow the electronic cigarette to be inserted and secured therein. A tab member is formed on the top cover.

An electronic cigarette container has a main body section having a hollow interior, the main body section having an open top end. A holding mechanism is formed at a bottom end of the main body section to hold an electronic cigarette. A top cover is coupled to the main body section to cover the open top end. A securing mechanism is formed on an interior surface of the top cover, wherein the securing mechanism removes the electronic cigarette from the container when the top cover is removed from the main body. A raised platform is formed on a bottom surface of the main body section, the holding mechanism formed on the raised platform. A tab member is formed on the top cover. A locking device is formed on the tab to secure the tab in a folded down position.

The features, functions, and advantages may be achieved independently in various embodiments of the disclosure or may be combined in yet other embodiments.

DESCRIPTION OF THE DRAWINGS

Embodiments of the disclosure will become more fully understood from the detailed description and the accompanying drawings, wherein.

DETAILED DESCRIPTION

Figure 1:
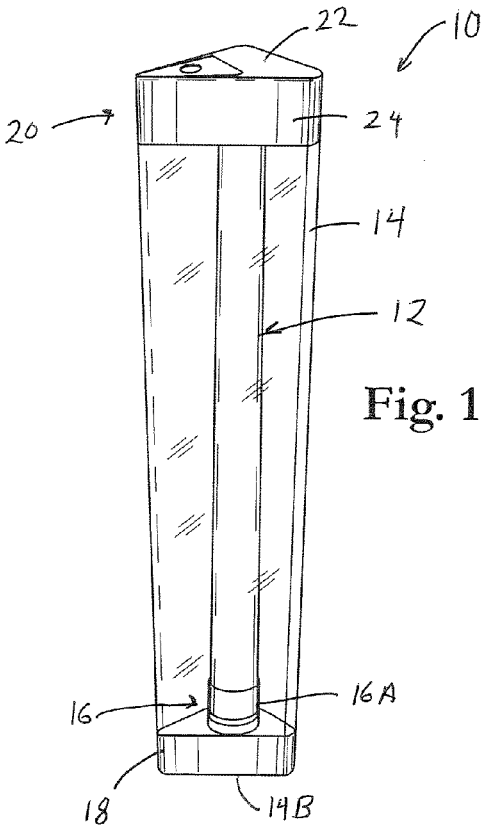
FIG. 1 is an elevational view of a first side of the electronic cigarette container with a tab in a closed position, the other sides being mirror images thereof.
Figure 2:
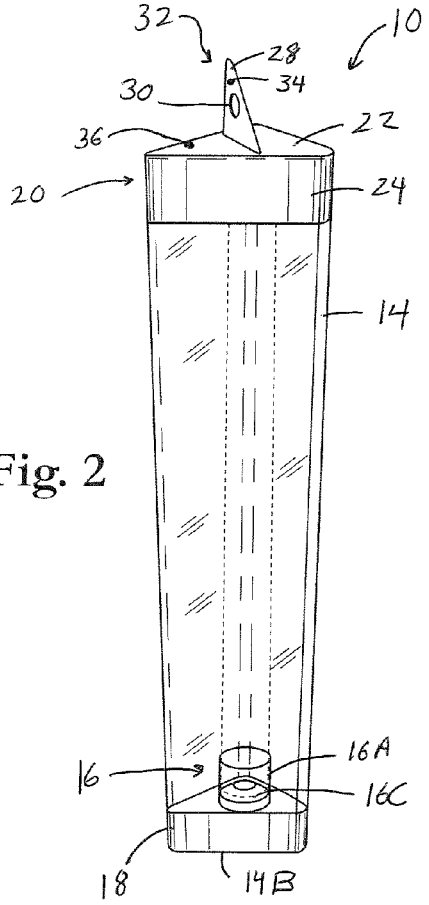
FIG. 2 is an elevational view of the first side of the electronic cigarette container with the tab in an elevated position.
Figure 3:
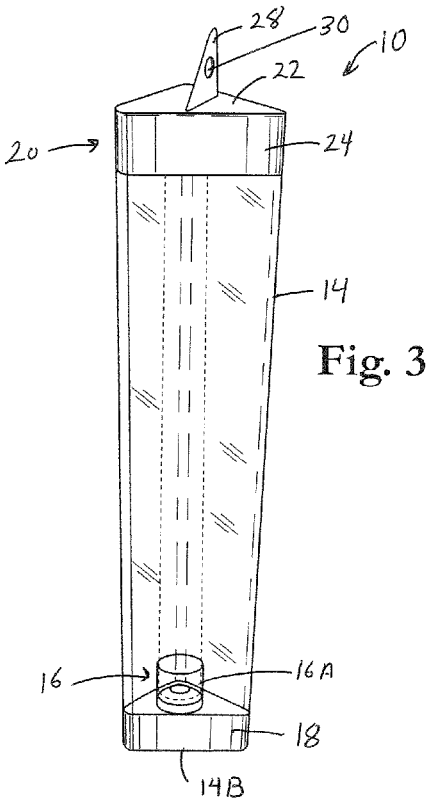
FIG. 3 is an elevational view of a second side of the electronic cigarette container with the tab in an elevated position.

Referring to the Figures, an electronic cigarette/cigar container 10 (hereinafter container 10) is shown. The container 10 may allow one to display the electronic cigarette/cigar 12 (hereinafter electronic cigarette 12) within the container 10. The container 10 may further allow one to provide a more stable platform when placing the container on a display. The container 10 may further provide a mechanism for removing the electronic cigarette 12 from the container 10.

The container 10 may be comprised of a main body section 14. The main body section 14 may be comprised of a translucent material. This may allow one to see the contents stored within the container 10. The translucent material may be a light weight and sturdy material such as plastic, or the like. The listing is given as an example and should not be seen in a limiting manner.

The main body section 14 may have a hollow interior. The main body section 14 may be formed in different geometrical shapes. In the embodiment shown in the Figures, the main body section 14 is formed in a triangular shape. The main body section 14 may be tapered. As shown in the Figures, the main body section 14 tapers towards a bottom end 14B.

At least one end of the main body section 14 may be open. In the present embodiment, a top end 14A is opened and a bottom end 14B is closed. However, the main body section 14 may be formed wherein both the top end 14A and the bottom end 14B may be open.

The bottom end 14B of the main body section 14 may have a holding device 16 formed thereon. The holding device 16 may be used to support the electronic cigarette 12 within the container 10. In the present embodiment, the holding device 16 is a circular tube member 16A. A diameter of the circular tube member 16A is of a size to allow the electronic cigarette 12 to be inserted therein and to minimize movement of the electronic cigarette 12 within the tube member 16A. The circular tube member 16A may have a slight taper such that the diameter of the circular tube member 16A is slightly larger at a top section. This may allow the electronic cigarette 12 to more easily be inserted into the circular tube member 16A.

In accordance with one embodiment, the circular tube member 16A may have a spring-loaded mechanism 16C. The spring loaded mechanism 16C may be used for extending and retracting the electronic cigarette 12. A number of different mechanisms can be used for raising and lowering the electronic cigarette 12. The electronic cigarette 12 may be automatically placed into the circular tube member 16A and thus the spring-loaded mechanism 16C without pressing it in by simply snapping the top cover 20 closed. In accordance with one embodiment, the electronic cigarette 12 may be automatically extended when the top cover 20 is opened.

The circular tube member 16A may be formed on a raised member 18 of the bottom end 14B. In the present embodiment, the bottom end 14B has a raised triangular shaped platform as the raised member 18.

The container 10 may have a top cover 20. The top cover 20 may be used to close the open top end 14A. In the embodiment shown, the top cover 16 is triangular shaped and has a top plate member 22. The top plate member 22 is dimensioned to be slightly larger than the size of the open top end 14A. Thus, the top plate member 22 may be placed on top of the open top end 14A to completely cover the open top end 14A.

Side wall members 24 may extend down from the top plate member 22. The side wall members 24 may be used to secure the top cover 16 within the open top end 14A. In the present embodiment, three side wall members 24 extend down from the top plate member 22 to form a triangular shape. The triangular shape of the three side wall members 24 is dimensioned to fit and hold the cover 16 within the open top end 14A.

Figure 4:
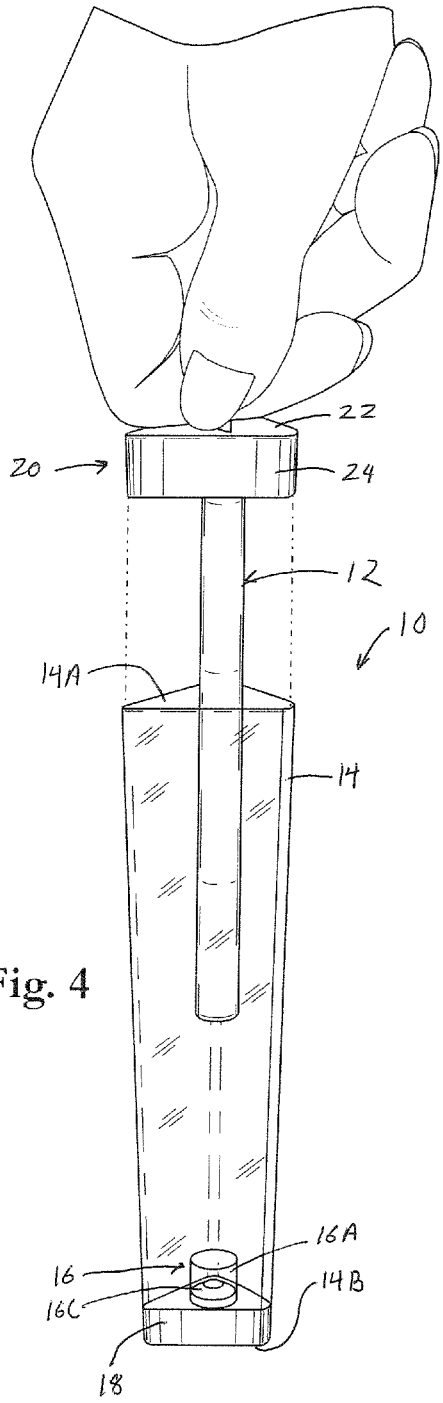
FIG. 4 is an elevational view of the first side of the electronic cigarette container with a top section removed extracting the electronic cigarette from the container.
Figure 5:
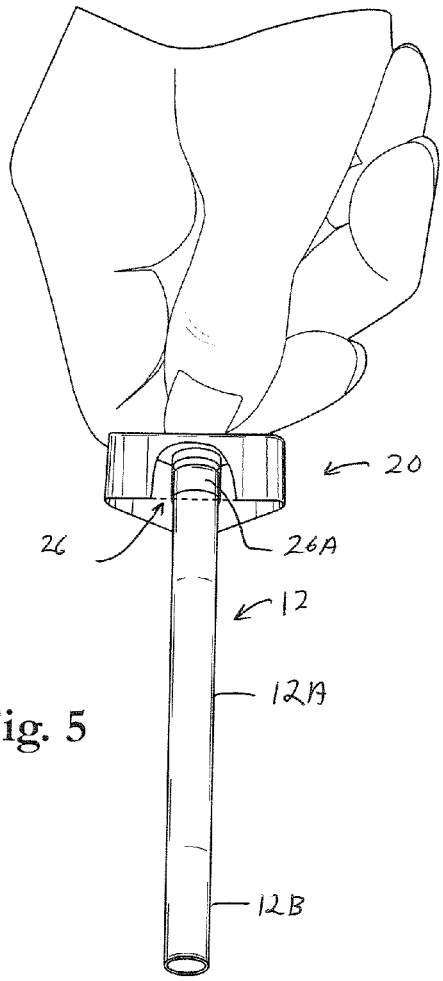
FIG. 5 is an elevational view of a first side of the top section of electronic cigarette container, having a cutaway showing an attachment for securing the electronic cigarette within the top section.
Figure 6:
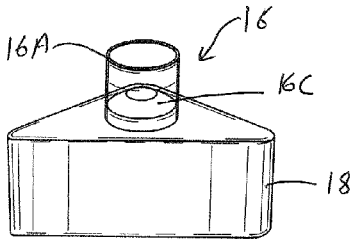
FIG. 6 is an elevational view of a first side of a bottom section of the electronic cigarette container, the other sides of the bottom surface being a mirror image thereof.
Figure 7:
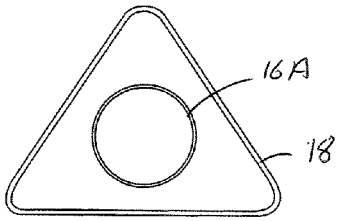
FIG. 7 is a top view of the bottom section.
Figure 8:
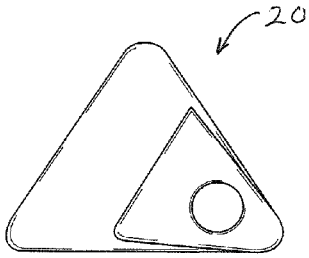
FIG. 8 is a top view of the top section with the tab in a closed position.

Extending down from the top plate member 22 is a securing device 26. The securing device 26 extends down from a central area of the top plate member 22. The securing device 26 may be used to secure the electronic cigarette 12 to the top cover 20 as shown in FIGS. 4-5. Thus, when the top cover 20 is removed from the container 10, the electronic cigarette 12 is withdrawn from the container 10. Since the electronic cigarette 12 may be secured to the top cover 20 as shown in FIGS. 4-5, one may easily detach the electronic cigarette 12 by gripping the body section 12A of the electronic cigarette 12 and pulling the electronic cigarette 12 away from the top cover 20. Thus, the securing device 26 may be used to allow the user of the electronic cigarette 12 to easily hold the body section 12A and not the section 12B that is inserted into the user's mouth thereby providing a sanitary benefit to the user. In the present embodiment, the securing device 26 is a circular tube member 26A. A diameter of the circular tube member 26A is of a size to allow the electronic cigarette 12 to be inserted and secured therein.

A tab member 28 may be formed on the top plate member 22. The tab member 28 may be used for several purposes. First, the tab member 28 may be used to withdraw the top cover 16 from the open top end 14A. As shown in FIGS. 4-5, when the top cover 20 is removed from the container 10, the electronic cigarette 12 is automatically withdrawn from the container 10. Thus, the tab member 28 may be used to easily remove the electronic cigarette 12 from the container 10. Second, the tab 28 may have an opening 30 formed there through. The opening 30 may be used to hang the container 10 from a display.

In the present embodiment, the tab 28 may be a foldable tab 28. Thus the tab 28 may be folded down to lay flat against the top plate member 22. The tab 28 may have a locking device 32. The locking device 32 may be used to secure the tab 28 against the top plate member 22. In accordance with one embodiment, the locking device 32 is a snap lock. The snap lock may be comprised of a stud 34 and a socket 36. The stud 34 may be formed on the tab 28 and the socket 36 may be formed on the top plate member 22. Alternatively, the socket 36 may be formed on the tab 28 and the stud 34 may be formed on the top plate member 22.

This disclosure provides exemplary embodiments of the present invention. The scope of the present invention is not limited by these exemplary embodiments. Numerous variations, whether explicitly provided for by the specification or implied by the specification, such as variations in structure, dimension, type of material and manufacturing process may be implemented by one of skill in the art in view of this disclosure.

What is claimed is:

1. An electronic cigarette container comprising:

a main body section having at least three side walls and a bottom, each side wall being translucent;

a cover releasably coupled to a first end of the main body section, the cover including a tab member coupled to an outer surface of the cover such that the cover is removable from the main body section by a user pulling the tab member;

wherein the bottom is at a second end of the main body section and includes a holding mechanism configured to hold an electronic cigarette; and the electronic cigarette;

wherein each wall of the main body section is tapered from the first end to the second end such that a cross section of the first end is larger than a cross section of the second end, and wherein the cover includes a securing mechanism configured to allow removal of the electronic cigarette from the container without the user contacting a surface of the electronic cigarette.

2. The electronic cigarette container of claim 1, wherein the main body section has exactly three side walls.

3. The electronic cigarette container of claim 2, wherein the cover has a triangular top surface, and the tab member is triangular.

4. The electronic cigarette container of claim 3, wherein the holding mechanism is a first circular tube for receiving a first end of the electronic cigarette, and the securing mechanism is a second circular tube for receiving a second end of the electronic cigarette.

5. The electronic cigarette container of claim 4, wherein the tab member includes an opening therein and a locking device to selectively secure the tab member against the cover.

* * * * *